US009243797B2

(12) United States Patent
Leung

(10) Patent No.: US 9,243,797 B2
(45) Date of Patent: Jan. 26, 2016

(54) WEARING APPAREL WITH LED LIGHT MODULE

(71) Applicant: Quanns Wanlap Leung, Arcadia, CA (US)

(72) Inventor: Quanns Wanlap Leung, Arcadia, CA (US)

( * ) Notice: Subject to any disclaimer, the term of this patent is extended or adjusted under 35 U.S.C. 154(b) by 284 days.

(21) Appl. No.: 13/925,848

(22) Filed: Jun. 25, 2013

(65) Prior Publication Data

US 2014/0376209 A1 Dec. 25, 2014

(51) Int. Cl.

| | |
|---|---|
| ***F21V 33/00*** | (2006.01) |
| ***A41D 13/01*** | (2006.01) |
| *F21W 121/06* | (2006.01) |
| *F21S 4/00* | (2006.01) |

(52) U.S. Cl.

CPC ..... *F21V 33/0008* (2013.01); *A41D 13/01* (2013.01); *F21V 33/004* (2013.01); *F21S 4/005* (2013.01); *F21W 2121/06* (2013.01)

(58) Field of Classification Search

CPC .. F21S 4/005; F21S 4/007; F21V 33/000004; F21V 33/0008; F21W 2121/06; A41D 13/01

USPC ..... 362/103, 249.02, 800

See application file for complete search history.

(56) References Cited

U.S. PATENT DOCUMENTS

| | | | | |
|---|---|---|---|---|
| 4,839,777 | A * | 6/1989 | Janko et al. | 362/108 |
| 5,128,843 | A * | 7/1992 | Guritz | 362/103 |
| 5,567,040 | A * | 10/1996 | Tabanera | 362/108 |
| 2011/0157863 | A1* | 6/2011 | Grimshaw | 362/34 |
| 2011/0199758 | A1* | 8/2011 | Yeh | 362/184 |
| 2011/0235311 | A1* | 9/2011 | Stone | 362/106 |
| 2012/0039069 | A1* | 2/2012 | Schrimmer | 362/103 |
| 2012/0155065 | A1* | 6/2012 | Ubaghs et al. | 362/103 |
| 2013/0077289 | A1* | 3/2013 | Gridley | 362/103 |

* cited by examiner

*Primary Examiner* — Evan Dzierzynski
*Assistant Examiner* — Zheng Song

(57) ABSTRACT

A wearing apparel includes at least a seam line and an elongated sleeve extended adjacent to the seam line. A LED light module has a flexible wire configuration allowing freedom of movement when the wearing apparel is worn. The LED light module includes a flexible light string received along the elongated sleeve and a power supply electrically connected to the light string. The light string generates a light effect thereby illuminating the wearer for ornamental and safety purpose.

4 Claims, 5 Drawing Sheets

WEARING APPAREL WITH LED LIGHT MODULE

CROSS REFERENCE WITH RELATED APPLICATION

This is a non-provisional application of a provisional application, Ser. No. 61/666,845 and filed Jun. 30, 2012.

BACKGROUND

1. Field of the Invention

The present invention relates to a wearing apparel. More particularly, the present invention relates a wearing apparel with a LED light module which has a predetermined flexibility to fix at the wearing apparel without substantially increasing the stiffness of the wearing apparel.

2. Discussion of the Related Art

People such as joggers, cyclists or street cleaners, can be in danger especially in poor weather conditions or at dusk or night time. In such circumstances, they often wear a jacket with light reflective material affixed thereon. However, such jacket requires reflection of light from the vehicle and may not be easily seen and revealed the presence of the person.

It is well known that the use of LED light on the wearing apparel to generate a safety light signal, wherein the LED light generally comprises a portable power supply, a circuit board, and a plurality of LEDs mounted on the circuit board. The LED light is fixed to the wearing apparel by affixing the circuit board on the garment of the wearing apparel.

LED lights are one of the most popular enthusiasts do to the wearing apparel. The main advantages of LED lights are high energy efficiency, extremely long service life, and low heat generation comparing with other light generators. The LED lights have good environmental performance including high temperature and high humidity resistance. Because each LED comprises a solidstate chip embedded in epoxy, each LED is hard to break or burn out.

However, the use of electronic components on the wearing apparel has several problems. The electronic components must be made of water resistance to prevent sweat, moisture, or rain on the wearing apparel. Any moisture entering into one of the electronic components will cause the malfunction of the LED light or even the short circuit of the LED light. In addition, the LED light must be lightweight to fix on the wearing apparel and must allow freedom of movement when the wearer wears the jacket. However, the LED light cannot be used for a windbreaker jacket which is a thin and lightweight jacket designed to resist wind chill and light rain and is commonly worn by a jogger. The LED light is too heavy, comparing with the weight of the windbreaker jacket, when the LED light is affixed thereto. Even though the circuit board can be made of soft material, the LED light will increase the stiffness of the windbreaker jacket. Therefore, the jogger will feel uncomfortable and will have less freedom of movement after wearing the windbreaker jacket. The LED light will also distort the ornamental design of the windbreaker jacket.

BRIEF SUMMARY OF THE INVENTION

The present invention overcomes the above mentioned drawbacks and limitation by incorporating a LED light module for a wearing apparel, which is a simple, compact and inexpensive device.

The primary objective of the present invention is that the LED light module is a flexible, non-fragile, compact, and lightweight to fix at the wearing apparel.

Another objective of the present invention is that the LED light module is received and hidden along the seam line of the wearing apparel.

Another objective of the present invention is that the LED light module is placed at the outer surface of the wearing apparel in an unseen manner.

Another objective of the present invention is that the LED light module is flexible enough to configure to any shape to extend along the wearing apparel.

Another objective of the present invention is that the LED light module is designed to be user-friendly. The LED light module is readily available, and inexpensive in manufacturing cost. Advantages include a requirement of very small power consumption, ease of installation, and extremely thin structure.

Another objective of the present invention is that the LED light module contains the advantages of high energy efficiency, extremely long service life, and low heat generation.

For a more complete understanding of the present invention with its objectives and distinctive features and advantages, reference is now made to the following specification and to the accompanying drawings.

BRIEF DESCRIPTION OF THE DRAWING(S)

DETAILED DESCRIPTION OF THE INVENTION

In accordance with a preferred embodiment of the present invention, the present invention provides a wearing apparel 100 with a LED light module 200.

Figure 1:
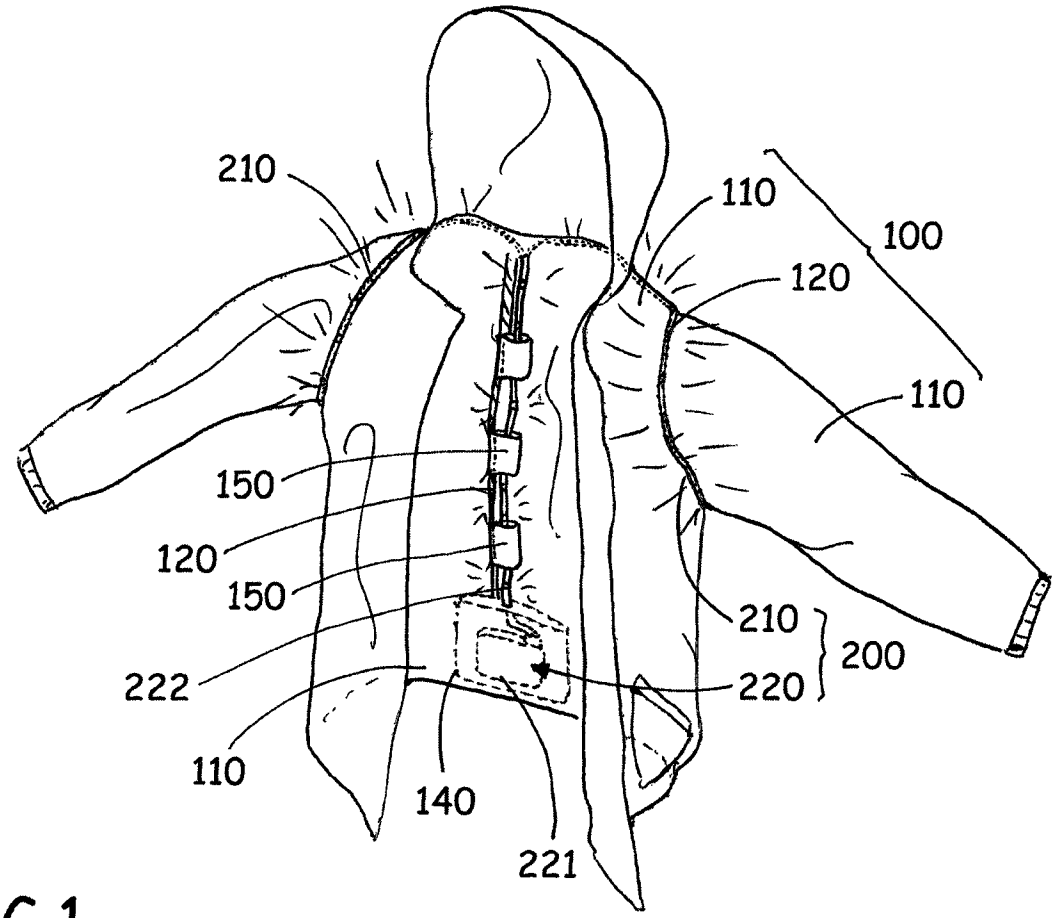
FIG. 1 is a schematic view of a wearing apparel with a LED light module in accordance with the presently embodiment of the invention.

In the presently embodiment, the wearing apparel 100 is illustrated in FIG. 1 as a windbreaker jacket and comprises a plurality of garment pieces 110 sewn along their margins to form a plurality of seam lines 120. When forming each seam line 120, an elongated sleeve 130 is formed alongside the seam line 120.

Figure 2:
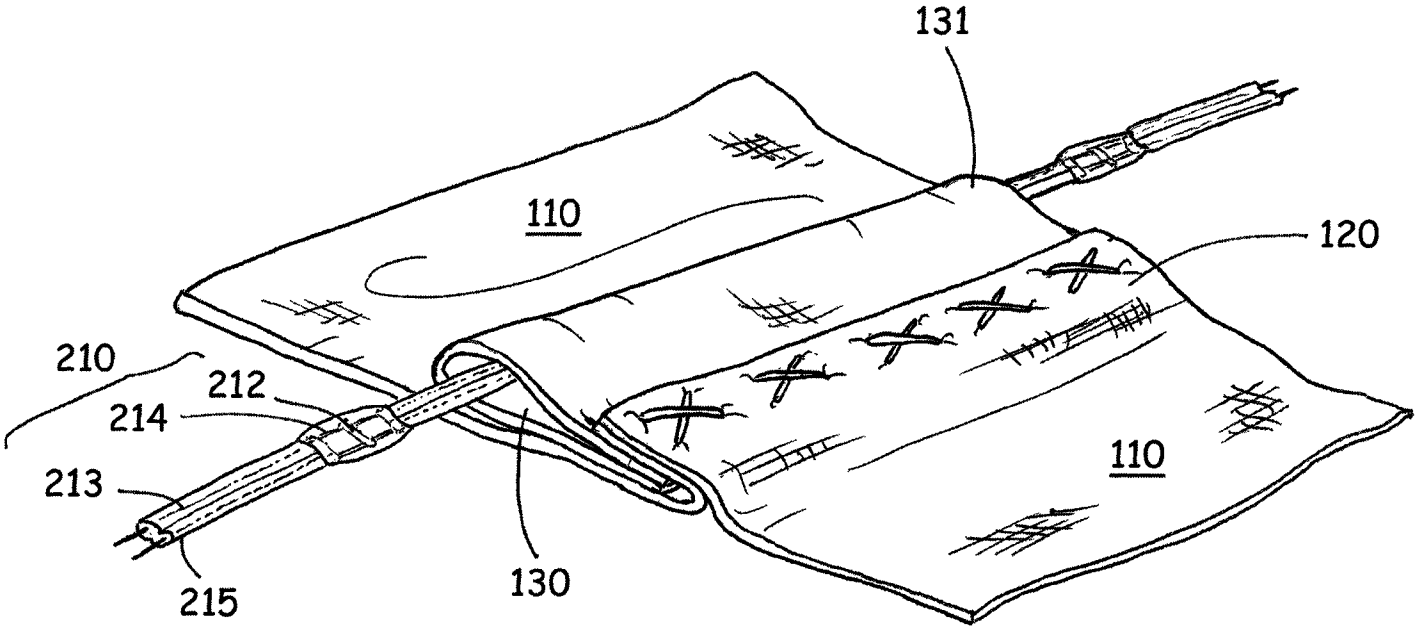
FIG. 2 is a schematic view of the formation of the seam line to receive the LED string in accordance with the presently embodiment of the invention.

FIG. 2 depicts the formation of the seam line 120, wherein two margins of the first and second garment pieces 110 are overlapped and then folded to the first garment piece 110, wherein the overlapped margins are sewn to the first garment piece 110 to form the seam line 120. Before the overlapped margins are sewn to the first garment piece 110, an elongated fabric piece 131 is overlapped in half to be sewn along the seam line 120. That is to say, two overlapped edges of the fabric piece 131 are sandwiched and sewn with the seam line 120 so that the mid-section of the fabric piece 131 is extended alongside the seam line 120 to form the elongated sleeve 130. It is preferred that the fabric piece 131 is made by the same material of the first and second garment pieces 110 to keep the ornamental appearance of the wearing apparel 100. Therefore, the elongated sleeve 130 is formed along and adjacent to the seam line 120. The elongated sleeve 130 is also formed at the outer surface of the wearing apparel 100. Specifically, not all the seam lines 120 will form the elongated sleeve 130. In FIG. 1, only the seam lines 120 between the arm sleeve garment piece 110 and the body garment piece 110 will contain the elongated sleeves 130.

In the presently embodiment, the LED light module 200 has a flexible wire configuration allowing freedom of movement when the wearing apparel 100 is worn. The LED light module 200 comprises a light string 210 received along the elongated sleeve 130 and a power supply 220 electrically connected to the light string 210. The light string 210 has a fastening end detachably affixed to the wearing apparel and a connecting end detachably coupled with the power supply 220.

The LED light module 200 of the invention can be utilized as the lighting system of the exterior of the wearing apparel 100 for safety purpose. The LED light module 200 of the invention can also form the decorative light for the wearing apparel 100.

Figure 3:
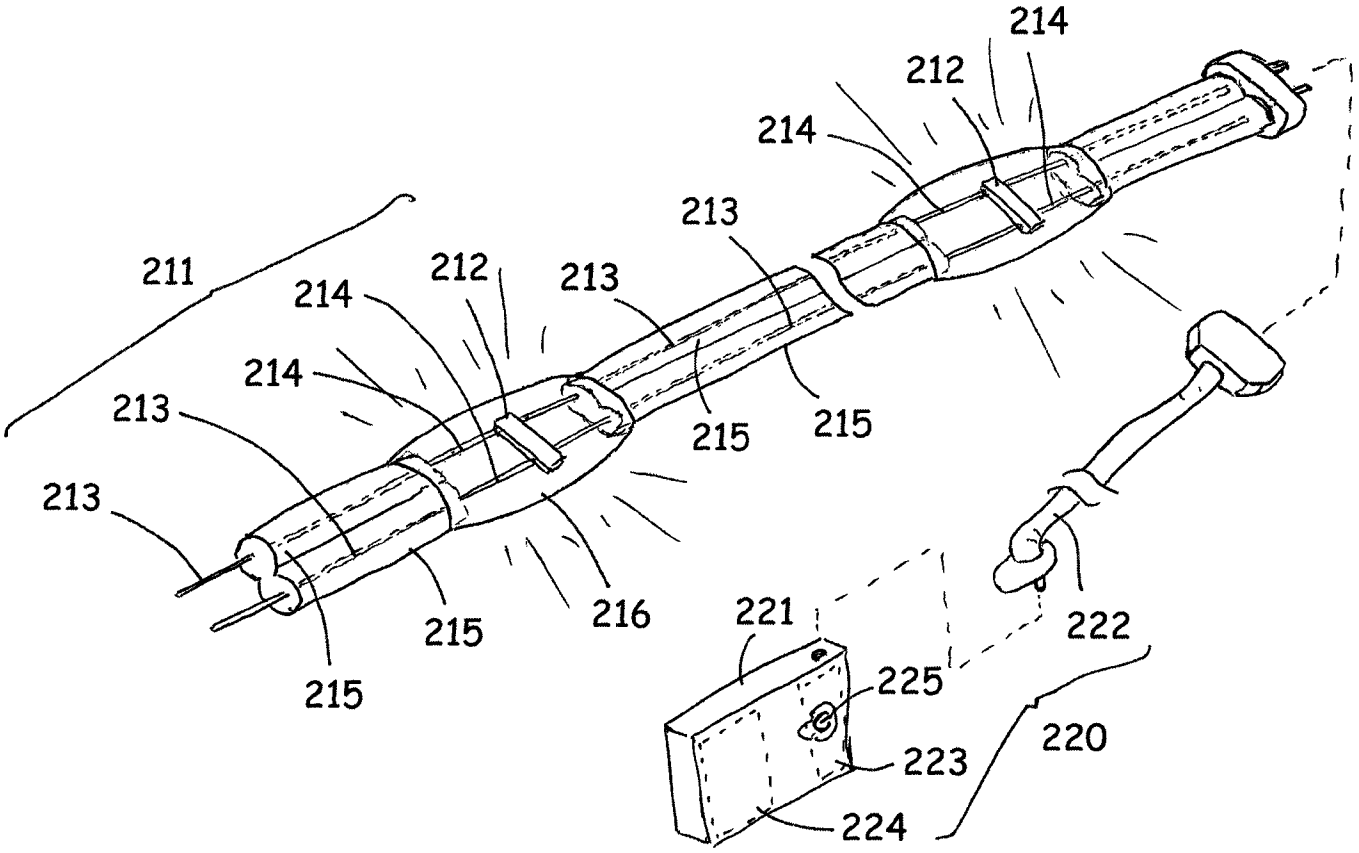
FIG. 3 is a schematic view of the light string of the LED light module in accordance with the presently embodiment of the invention.
Figure 4:
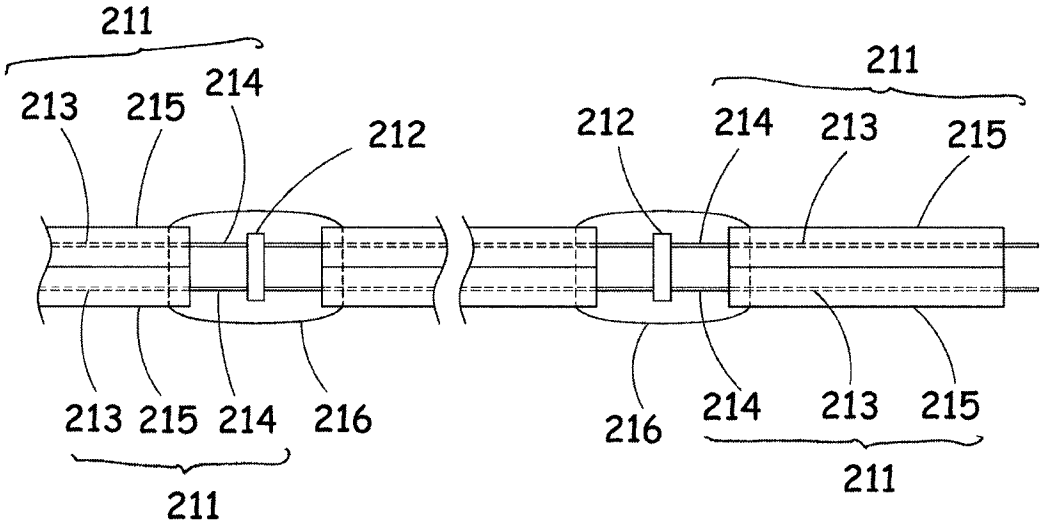
FIG. 4 is a top view of the light string of the LED light module in accordance with the presently embodiment of the invention.

FIGS. 3 and 4 depict the structure of the light string 210 which comprises two conductive elements 211 and a plurality of diodes 212 spacedly coupled along the conductive elements 211. The conductive elements 211 are parallel with each other with a predetermined distance. Each of the conductive elements 211 comprises a plurality of flexible conductive fabrics 213 and a plurality of conductive wires 214 alternating connected to the flexible conductive fabrics 213. Therefore, each conductive wire 214 is conductively connected between two adjacent flexible conductive fabrics 213 end-to-end. In the presently embodiment, the two conductive elements 211 are extended in parallel that the flexible conductive fabrics 213 of one conductive element 211 are aligned with and positioned alongside the flexible conductive fabrics 213 of another conductive element 211. The conductive wires 214 of one conductive element 211 are aligned with and positioned alongside the conductive wires 214 of another conductive element 211. Each of the diodes 212 is electrically coupled at the two adjacent conductive wires 214 of the conductive elements 211. Therefore, no circuit board is needed to connect with the diodes 212. The light string 210 will generate a light effect via the diodes 212 thereby illuminating the wearer for ornamental and safety purpose.

The light string 210 further comprises a plurality of insulation sleeves 215 coaxially encircled with the flexible conductive fabrics 213 of the conductive elements 211. Therefore, when the flexible conductive fabrics 213 of the conductive elements 211 are encircled within and embedded in the insulation sleeves 215, the flexible conductive fabrics 213 of the conductive elements 211 will not contact with each other that may cause the short circuit. The insulation sleeves 215 are made of flexible and electrical insulating material such as plastic. The insulation sleeves 215 separate the flexible conductive fabrics 213 of the conductive elements 211 at the predetermined distance.

The light string 210 further comprises a plurality of diode sealers 216, wherein the diodes 212 are enclosed within the diode sealers 216. The diode sealer 216 is made of waterproof and insulated material and is constructed in a non-hollow configuration, i.e. solid configuration, so that the diodes 212 are entirely embedded and protected by the diode sealers 216. It is preferred that the diode sealer 216 is made of epoxy. The insulation sleeves 215 are sealed with and coupled to the diode sealers 216 end-to-end to retain the diodes 212 at the predetermined distance. In FIG. 3, two end portions of each of the diode sealers 216 are integrated with and coupled to two corresponding ends of the insulation sleeves 215. The connection between the diode sealer 216 and the insulation sleeve 215 will ensure the electrically conductive connection between the flexible conductive fabric 213 and the conductive wire 214.

In the presently embodiment, the flexible conductive fabric 213 provides sufficient flexibility allowing freedom of movement of the conductive element 211. The conductive wire 214 provides sufficient rigidity supporting the diode 212 thereat. The length of the flexible conductive fabric 213 is way longer than the length of the conductive wire 214 so that the light string 210 will provide sufficient freedom of movement when the wearing apparel 100 is worn. The length of the flexible conductive fabric 213 can be configured from 50 mm to 20 mm. The length of the conductive wire 214 is lesser than 10 mm. The length of the flexible conductive fabric 213 is set as the interval between two adjacent diodes 212. The diameter size of the light string 210 is lesser than 5 mm.

When the light string 210 is not activated and is received along the elongated sleeve 130, the light string 210 is hidden therewithin and cannot be seen. When the light string 210 is activated, the diodes 212 are activated to generate light penetrating through the elongated sleeve 131. Therefore, the LED light module 200 can be utilized as the lighting system of the exterior of the wearing apparel 100 for safety purpose and can also form the decorative light for the wearing apparel 100.

FIG. 3 depicts the power supply 220 which comprises a control box 221 and a connection cable 222 extended from the control box 221 to detachably link to the connecting end of the light string 210.

The power supply 220 further comprises a control circuit 223 and a battery source 224 received in the control box 221. A control switch 225 is provided at the outer side of the control box 221 and electrically linked to the control circuit 223. The control circuit 223 provides power management to control cyclical flashing and continuous lighting generated by the diodes 212 by the actuation of the control switch 225. The battery source 224, which is a DC power source, can be a rechargeable battery received in the control box 221 and connected to the control circuit 223. Or, the battery source 224 can be a replaceable battery replaceably received in the control box 221 and connected to the control circuit 223. The output of the battery source 224 is preferred to be 3.7V-600 mAh and the charging of the battery source 224 is preferred to be DC5.0V-200 mAh.

In FIG. 1, the wearing apparel 100 further comprises a power pocket 140 provided at the outer surface of the back garment piece 110 at the bottom portion thereof, wherein the control box 221 is received in the power pocket 140. A plurality of guiding loops 150 are spacedly formed at the inner surface of the back garment piece 110, wherein the guiding loops 150 are formed along the seam line 120 at the back garment piece 110. The connection cable 222 is guided to extend from connecting end of the light string 210 to the control box 221 through the guiding loops 150.

In order to wash the wearing apparel 100, the power supply 220 can be detached from the light string 210, wherein the wearing apparel 100 with the light string 210 extended along the elongated sleeve 130 can be machine washable.

Figure 5:
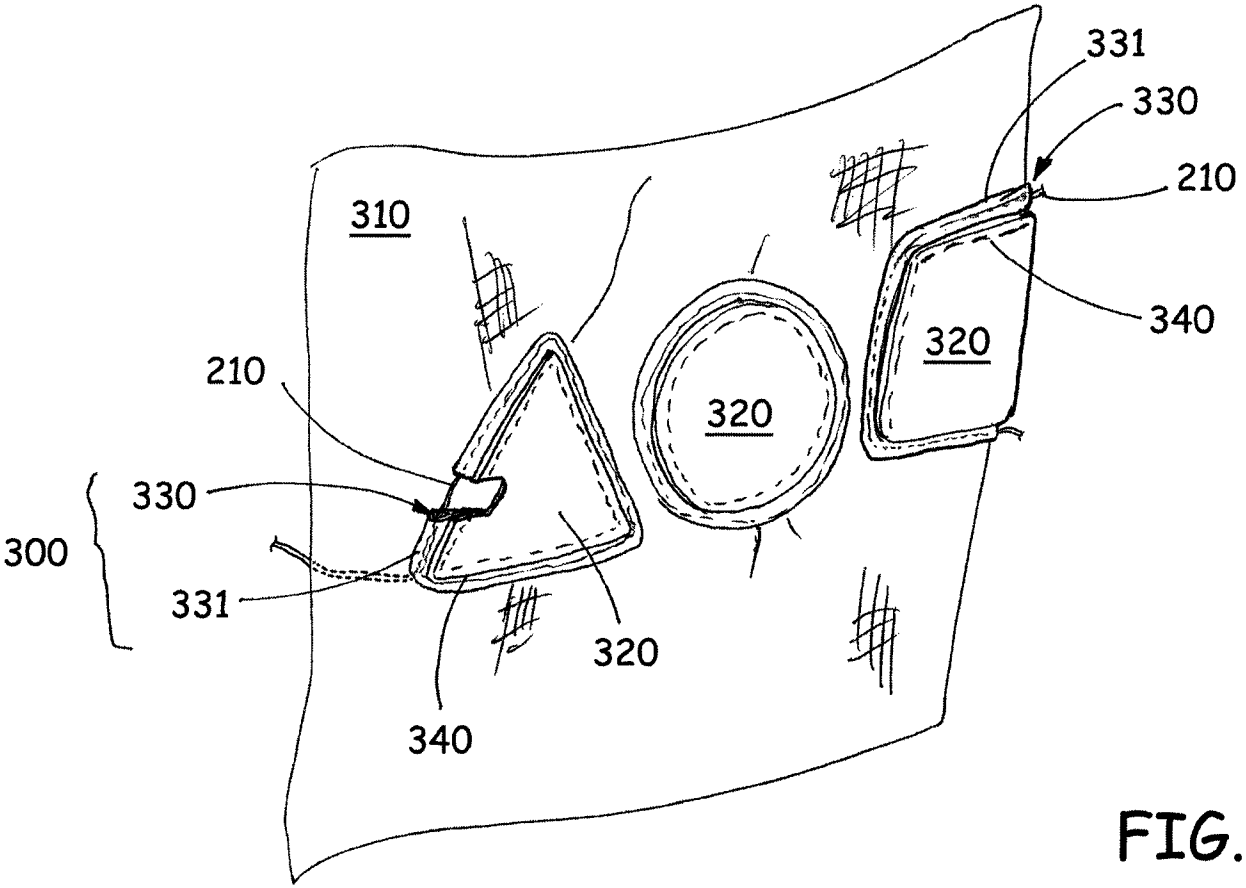
FIG. 5 shows an alternative formation of the elongated sleeve of the wearing apparel in accordance with the presently embodiment of the invention.

FIG. 5 depicts an alternative formation of the elongated sleeve of the wearing apparel 300 which comprises a garment piece 310 and an add-on piece 320 overlapped with the outer garment piece 310, wherein the elongated sleeve 330 is formed the seam line 340 at the add-on piece 320 on the garment piece 310. The add-on piece 320 can be made by the same or different material of the garment piece 310, wherein the add-on piece 320 can be formed as a decorative fabric panel or a logo panel sewn on the garment piece 310. When the add-on piece 320 is sewn to the garment piece 310, the seam line 340 is formed at the peripheral edge of the add-on piece 320 on the garment piece 310. The elongated fabric piece 331 is overlapped in half to be sewn along the seam line 320 to form the elongated sleeve 330. Therefore, the elongated sleeve 330 is formed alongside the seam line 340. The elongated sleeve 330 is preferably formed at the outer surface of the wearing apparel 300 at the garment piece 310.

It should be appreciated that the light string 210 can be received at the brim of a cap, wherein the elongated sleeve 130 or 330 is formed along the seam line of the brim and/or the cap body of the cap.

While the embodiments and alternatives of the invention have been shown and described, it will be apparent to one skilled in the art that various other changes and modifications can be made without departing from the spirit and scope of the invention.

What is claimed is:

1. An article, comprising a wearing apparel and a LED light module, wherein said wearing apparel comprises a plurality of garment pieces sewn along their margins and a plurality of seam lines, wherein said LED light module is provided along at least one of said seam lines for allowing freedom of movement when said wearing apparel is worn;

wherein said wearing apparel further comprises an elongated sleeve formed alongside said seam line to receive said LED light module, wherein said garment pieces are sewn along their margins to form said seam lines;

wherein said LED light module comprises a light string received along said elongated sleeves and power supply electrically and detachably connected to said light string, wherein said light string is flexible enough for allowing freedom of movement when said wearing apparel is worn;

wherein said power supply comprises a control box and a connection cable extended from said control, box to detachably link to a connecting end of said light string;

wherein said wearing apparel further comprises a power pocket provided at one of said garment piece as a back garment piece at a bottom portion thereof, wherein said control box is received in said power pocket;

wherein said wearing apparel further comprises a plurality of guiding loops spacedly formed at an inner surface of said back garment piece, wherein said guiding loops are formed along said seam line at the back garment piece, wherein said connection cable is guided to extend from said connecting end of said light string to said control box through said guiding loops.

2. The article in claim 1 wherein said power supply further comprises a control circuit and a battery source received in said control box, and a control switch provided at an outer side of said control box and electrically linked to said control circuit.

3. An article, comprising a wearing apparel and a LED light module, wherein said wearing apparel comprises a plurality of garment pieces sewn along their margins and a plurality of seam lines, wherein said LED light module is provided along at least seam lines for allowing freedom of movement when said garment apparel is worn;

wherein said wearing apparel further comprises an elongated sleeve formed alongside said seam line to receive said LED light module, wherein said garment pieces are sewn along their margins to farm said seam lines;

wherein said wearing apparel further comprises an elongated fabric piece overlapped to be sewn along said seam line in which two overlapped edges of said fabric piece are sandwiched and sewn with said seam line so that a mid-section of said fabric piece is extended alongside said seam line to form said elongated sleeve;

wherein said LED light module comprises a light string received along said elongated sleeve and a power supply electrically and detachably connected to said light string, wherein said light string is flexible enough for allowing freedom of movement when said wearing apparel is worn;

wherein said light string which comprises two conductive elements and a plurality of diodes spacedly coupled along said conductive elements, wherein each of said conductive elements comprises a plurality of flexible conductive fabrics and a plurality of conductive wires alternating connected to said flexible conductive fabrics, so that each of said conductive wires is conductively connected between two adjacent flexible conductive fabrics end-to-end;

wherein said light string further comprises a plurality of insulation sleeves coaxially encircled with said flexible conductive fabrics of said conductive elements In order to separate said flexible conductive fabrics of said conductive element at a predetermined distance;

wherein said light string further comprises a plurality of diode sealers, wherein said diodes are enclosed within said diode sealers, wherein two end portions of each of said diode sealers are integrated with and coupled to two corresponding ends of said insulation sleeves;

wherein said power supply cpmprises a control box and a connection cable extended from said control box to detachably link to a connecting end of said light string;

wherein said wearing aware further comprises a power pocket provided at one of said garment piece as a back garment piece at a bottom portion thereof, wherein said control box is received in said power pocket;

wherein said wearing apparel further comprises a plurality of guiding loops spacedly formed at an inner surface of said back garment piece, wherein said guiding loops are formed along said seam line at the back garment piece, wherein said connection cable is guided to extend from said connecting end of said light string to said control box through said guiding loops.

4. The article in claim 3 wherein said power supply further comprises a control circuit and a battery source received in said control box, and a control switch provided at an outer side of said control box and electrically linked to said control circuit.

* * * * *